US007182343B2

(12) United States Patent
Doskocil et al.

(10) Patent No.: US 7,182,343 B2
(45) Date of Patent: Feb. 27, 2007

(54) FOOTBALL BOARD GAME

(76) Inventors: Samuel L. Doskocil, 9 Lancaster Pl., Andover, MA (US) 01810; Douglas C. Doskocil, 9 Lancaster Pl., Andover, MA (US) 01810

( * ) Notice: Subject to any disclaimer, the term of this patent is extended or adjusted under 35 U.S.C. 154(b) by 0 days.

(21) Appl. No.: 11/031,312

(22) Filed: Jan. 7, 2005

(65) Prior Publication Data

US 2006/0151949 A1 Jul. 13, 2006

(51) Int. Cl.
*A63F 3/00* (2006.01)

(52) U.S. Cl. ..... 273/277; 273/247

(58) Field of Classification Search ..... 273/277, 273/247, 244

See application file for complete search history.

(56) References Cited

U.S. PATENT DOCUMENTS 3,947,039 A * 3/1976 Sadler et al. ..... 273/247
4,094,509 A * 6/1978 Barron ..... 273/247
5,186,461 A * 2/1993 Tucker ..... 273/247
5,496,036 A * 3/1996 Chester ..... 273/247
5,769,419 A * 6/1998 Hill ..... 273/247
2004/0160002 A1* 8/2004 England ..... 273/247

* cited by examiner

*Primary Examiner*—Vishu K. Mendiratta
(74) *Attorney, Agent, or Firm*—Goodwin Procter LLP

(57) ABSTRACT

A football board game may be played with a football board, a pair of dice, and a coin or other device suitable as a marker. The coin is placed on a starting position, each player rolls a die, and the resulting die values are compared to determine the amount by which the coin should be advanced. If the coin advances to the defense's goal line before the offense has to turn over the ball four attempts, the offense has scored a touchdown.

1 Claim, 3 Drawing Sheets

| Plays | | |
|---|---|---|
| Offense | Defense | Result |
| 1 | 1 | No Gain/No Loss |
| 2 | 1 | 10 yard Gain |
| 3 | 1 | 20 yard Gain |
| 4 | 1 | 30 yard Gain |
| 5 | 1 | 40 yard Gain |
| 6 | 1 | 50 yard Gain<br>First Down |
| 1 | 2 | No Gain/No Loss |
| 2 | 2 | No Gain/No Loss |
| 3 | 2 | 10 yard Gain |
| 4 | 2 | 20 yard Gain |
| 5 | 2 | 30 yard Gain |
| 6 | 2 | 40 yard Gain<br>First Down |
| 1 | 3 | No Gain/No Loss |
| 2 | 3 | No Gain/No Loss |
| 3 | 3 | No Gain/No Loss |
| 4 | 3 | 10 yard Gain |
| 5 | 3 | 20 yard Gain |
| 6 | 3 | 30 yard Gain<br>First Down |
| 1 | 4 | No Gain/No Loss |
| 2 | 4 | No Gain/No Loss |
| 3 | 4 | No Gain/No Loss |
| 4 | 4 | No Gain/No Loss |
| 5 | 4 | 10 yard Gain |
| 6 | 4 | 20 yard Gain<br>First Down |
| 1 | 5 | No Gain/No Loss |
| 2 | 5 | No Gain/No Loss |
| 3 | 5 | No Gain/No Loss |
| 4 | 5 | No Gain/No Loss |
| 5 | 5 | No Gain/No Loss |
| 6 | 5 | No Gain/No Loss<br>First Down |
| 1-6 | 6 | Loss of 10 yards |

| Plays | | |
|---|---|---|
| Offense | Defense | Result |
| 1 | 1 | No Gain/No Loss |
| 2 | 1 | 10 yard Gain |
| 3 | 1 | 20 yard Gain |
| 4 | 1 | 30 yard Gain |
| 5 | 1 | 40 yard Gain |
| 6 | 1 | 50 yard Gain<br>First Down |
| 1 | 2 | No Gain/No Loss |
| 2 | 2 | No Gain/No Loss |
| 3 | 2 | 10 yard Gain |
| 4 | 2 | 20 yard Gain |
| 5 | 2 | 30 yard Gain |
| 6 | 2 | 40 yard Gain<br>First Down |
| 1 | 3 | No Gain/No Loss |
| 2 | 3 | No Gain/No Loss |
| 3 | 3 | No Gain/No Loss |
| 4 | 3 | 10 yard Gain |
| 5 | 3 | 20 yard Gain |
| 6 | 3 | 30 yard Gain<br>First Down |
| 1 | 4 | No Gain/No Loss |
| 2 | 4 | No Gain/No Loss |
| 3 | 4 | No Gain/No Loss |
| 4 | 4 | No Gain/No Loss |
| 5 | 4 | 10 yard Gain |
| 6 | 4 | 20 yard Gain<br>First Down |
| 1 | 5 | No Gain/No Loss |
| 2 | 5 | No Gain/No Loss |
| 3 | 5 | No Gain/No Loss |
| 4 | 5 | No Gain/No Loss |
| 5 | 5 | No Gain/No Loss |
| 6 | 5 | No Gain/No Loss<br>First Down |
| 1-6 | 6 | Loss of 10 yards |

Fig. 2

| Field Goals | | |
|---|---|---|
| Offense | Defense | Result |
| 1-6 | 1 | Field goals is successful (3 points) if the amount of offense roll multiplied by 10 exceeds distance to defense's goal line by 10 yards. If unsuccessful, loss of 10 yards and defense takes over as offense. |
| 1-6 | 6 | Field goal is blocked. Loss of 10 yards, and defense takes over as offense |
| Punts | | |
| Offense | Defense | Result |
| 1-6 | 1-5 | Move coin ahead 10 yards times amount of offense roll, or to defense 20 yard line if punted distance goes beyond goal line. |
| 1-6 | 6 | Blocked punt. Coin is not moved. |
| Extra Points | | |
| Offense | Defense | Result |
| 1-6 | 1-5 | Extra point is good. |
| 1-6 | 6 | Extra point attempt is blocked. |
| Two Point Conversions | | |
| Play a single down according to "plays." Offense scores a two point conversion if any yardage gain is achieved. | | |
| Safety | | |
| Defense rolls a 6 when coin is on the goal line of the offense. | | |

Fig. 3

FOOTBALL BOARD GAME

FIELD OF THE INVENTION

This invention relates to board games, and in particular a football board game in which a pair of dice is used as a mechanism for play.

BACKGROUND

American football is a well-known outdoor sport in the United States. Many games have been created to simulate actual football, and to allow two players to enjoy a game. Many of these games involve computers or cards.

It is an object of the invention to provide a football board game that is simple to learn and play, and does not require a significant amount of equipment.

SUMMARY OF THE INVENTION

An embodiment of the invention is directed to a method for playing a football board game comprising the steps of placing a marker on a first position on a board that represents a football field, rolling a first die to yield a first value, rolling a second die to yield a second value, and comparing the first value to the second value to determine a distance by which the marker will be moved on the board. The steps of rolling the first die, rolling the second die, and comparing may be repeated until a subsequent position of the marker indicates a score or a change in possession. The step of comparing may represents a down, and a turnover may be achieved when four downs have been played without a first down being achieved.

In at least one embodiment, a first down is achieved when the first value is a six. A turnover may be achieved when a punt attempt fails or a field goal attempt fails. The step of comparing may include determining the distance to be an amount by which the first value exceeds the second value, and wherein the distance is a gain of ten yards multiplied by the amount. The step of comparing may further include determining the distance to be zero if the second value is greater than or equal to the first value. The step of comparing may include determining the distance to be a loss of ten yards if the second value is a six, and determining the distance to be zero if the second value is greater than or equal to the first value. The method may further include a step of moving the marker a distance from the first position to a second position, and scoring a touchdown if the second position is at or beyond a goal line. The method may further include a step of subsequently rolling the first die and the second die to represent a field goal attempt, and may also include a step of subsequently rolling the first die and the second die to represent a punt.

DESCRIPTION OF THE FIGURES

FIG. 2 depicts how football downs are conducted in accordance with one embodiment of the invention.

FIG. 3 depicts how field goals, punts, extra points, two point conversions, and safeties are conducted in accordance with an embodiment of the invention.

DETAILED DESCRIPTION

Figure 1:
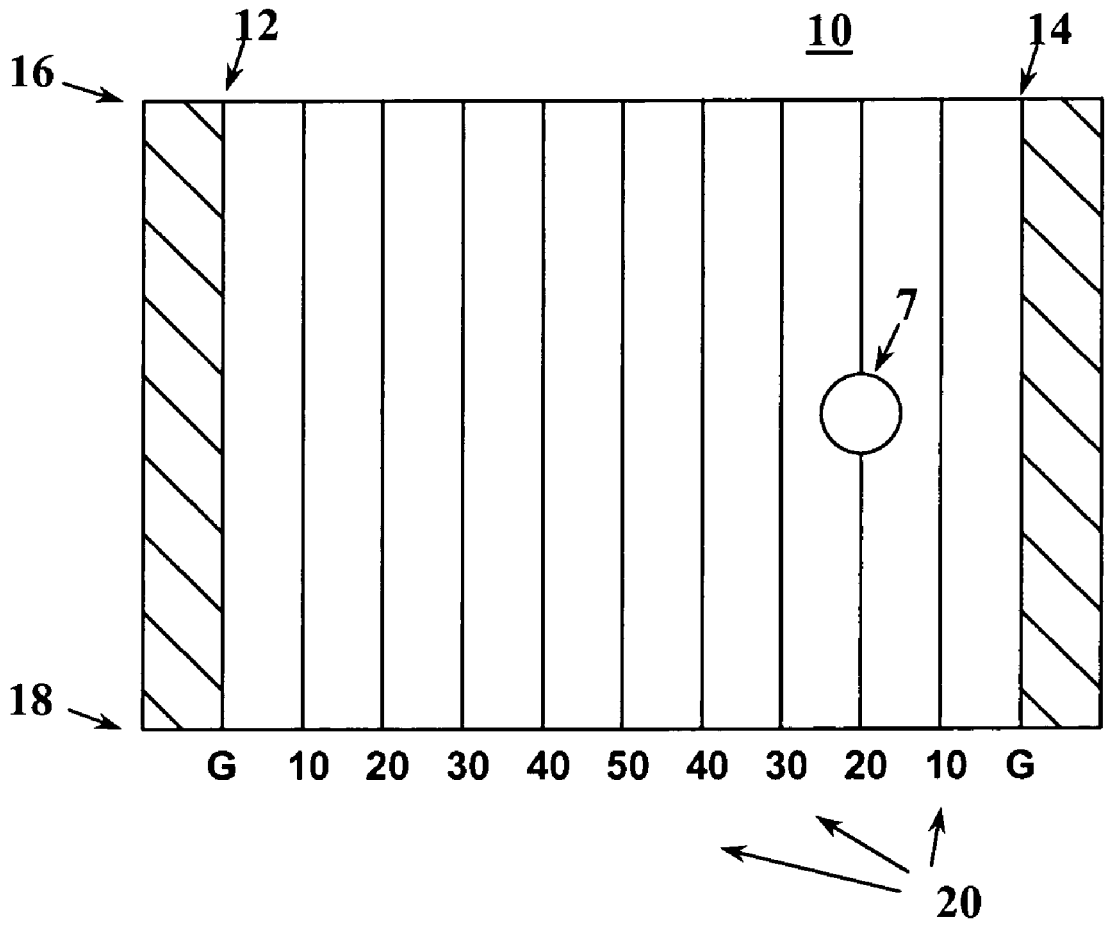
FIG. 1 depicts a football field board that can be used in conjunction with an embodiment of the invention.

FIG. 1 shows a football field board 10 that can be used in conjunction with an embodiment of the invention. FIG. 1 generally shows a first goal line 12, a second goal line 14, out-of-bounds lines 16 and 18, and yardage markers 20. FIG. 1 also shows a coin 7 that represents the field position of one of the two teams at play. Although embodiments of the invention are described using a coin as the marker, it will be understood that any device may be used to mark the current position of the offense. In the example shown in FIG. 1, the team having the ball (the offense) is on its own 20-yard line. The offense can score a touchdown by reaching the defense's end zone 12, in which case the offense will obtain six points. The offense can also score three points by successfully kicking a field goal, and score points in other ways similar to an actual football game.

Kickoff

The players first choose which player will be the offense first. This can be decided by each player rolling his die, and the player who rolls the higher amount goes first.

In one embodiment, play begins by placing the coin on the kicking team's 40 yard line, and having the kicking team roll his die. The kick amount is the amount of the defense die roll. For example, if the kicking team rolls a 3, then the kick is 30 yards, and the coin is thus placed on the receiving teams 30 yard line. The receiving team then becomes the offense, and begins "plays" as described below.

In another embodiment, the play begins with the offense at the 20-yard line.

Plays

To play, each player rolls a die, and the resulting die values are compared to determine the amount by which the coin should be advanced. In one embodiment, if the defense does not roll a six, the offense advances by the amount representative of the amount by which the offense's die value exceeds the defense's die value, if any, e.g., 10 yards per dot. If the defense rolls a six, the coin is moved backwards by ten yards, regardless of the offense's roll. If the defense does not roll a six and the offense's roll does not exceed the defense's roll, then the coin remains at its previous position, i.e., the line of scrimmage.

FIG. 2 shows advances or losses in yards for individual plays, also called downs, of one embodiment of the invention. Play continues until the offense scores by reaching the defense's goal line 12, in which case he is awarded six points, or until the defense takes over the offense, e.g., by loss of downs or by punt.

As can be observed, the probabilities associated with the dice rolls and the rules associated with the invention simulate many typical football games, for example: it is easier for the offense to gain yards than to lose yards; field goals are easier to score than touchdowns; and extra points are easier to score than two-point conversions. Other similarities can also be observed.

First Downs

If the offense has played four downs in a row without obtaining a first down or without scoring, the other player "takes over on downs" and becomes the offense, beginning play at the location where the previous offense was last located.

In one embodiment, the offense obtains a first down by rolling a six in any single play. This is represented in FIG. 2.

In other embodiments, the offense obtains a first down by gaining a certain number of yards, e.g., 30 yards before using up its four downs.

Field Goals

Prior to any down, the offense may declare that he will attempt a field goal. If he does, both players roll, and if the defense's roll is six, the field goal attempt is blocked, the coin is moved back 10 yards, and the defense takes over as offense. If the defense rolls a five or less, then the offense's roll represents the distance of the kick. Since goal posts are located 10 yards beyond the goal line, to be a successful field goal attempt the offense must roll a value that, when multiplied by ten yards, advances the coin ten yards beyond the goal line from the current field position. If the kick is unsuccessful because it is not long enough, the coin is moved back 10 yard and the defense takes over as offense. FIG. 3 depicts how field goals are conducted in accordance with one embodiment of the invention. FIG. 3 also shows how punts, extra points, two point conversions, and safeties are conducted in accordance with an embodiment of the invention.

Punts

Prior to any down, the offense may declare that he will punt. If he does, each player rolls his die and in one embodiment the coin is moved forward by a distance of ten yards times the amount of the offense's die roll up to the receiving team's goal line, unless the defense rolls a six in which case the coin remains where it was previously located. If the punt distance goes beyond the receiving team's goal line, then the coin is placed on the receiving team's 20 yard line In this manner, a roll of six by the defense simulates a blocked punt. After a punt, the team which was recently the defense becomes the offense, and begins at the location of the coin.

Safety

In one embodiment, the defense may score two points by forcing the offense back into its own end zone 14. After a safety is scored, the team who just scored the safety becomes the offense and proceeds with a kickoff. Thus, for example, if the offense begins at its 20 yard line, and the defense rolls two sixes in a row, the defense would score a safety.

Extra Point

After scoring a touchdown, the offense can attempt an extra point. The offense first will declare that he will attempt an extra point rather than a two-point conversion. To determine whether an extra point is achieved, each player rolls his die, and the extra point is scored unless the defense rolls a six. In this manner, a roll of six by the defense represents a blocked extra point.

Two-point Conversion

Another option for an offense that has just scored a touchdown is to attempt a two-point conversion. In one embodiment, after declaring his choice to attempt a two-point conversion rather than an extra point, the offense attempts a two-point conversion by placing his coin on the defense's 10-yard line, and having each player roll his die and comparing the die values as described above in "Plays" to determine whether the offense reaches the end zone in a single play. If the offense reaches the end zone in this single play, the offense is awarded two points.

Game Duration

There are several ways in which to determine the length of the game. In one embodiment, the winner is the player that reaches a certain number of points first, e.g., 21 points. In another embodiment, a full game is made up of two halves, and each half consists of a fixed number of possessions by each team, e.g., four. In other embodiments, the game may be played for a certain amount of time, e.g., 30 minutes.

Game Example

An example of game play in accordance with one embodiment of the invention is described below. In this example, there are two players—Thaddeus and Bailey.

Opening Kickoff: Each player rolls a die to determine who will kickoff and who will receive; Thaddeus rolls a 5 and Bailey rolls a 3, so Thaddeus will receive the opening kickoff and begin as offense. The coin is placed on Bailey's 40 yard line. Bailey rolls a 4 for the opening kickoff, so the coin is moved to Thaddeus's 20 yard line.

First Drive: First down—Thaddeus rolls a 4 and Bailey rolls a 2, so the coin is moved forward 20 yards to Thaddeus's 40 yard line. Second down—Thaddeus rolls a 3 and Bailey rolls a 6, so the coin is moved back 10 yards to Thaddeus's 30 yard line. Third down—Thaddeus rolls a 6 and Bailey rolls a 3, so the coin is moved forward 30 yards to Bailey's 40 yard line and Thaddeus is awarded a first down. First down—Thaddeus rolls a 5 and Bailey rolls a 1, so the coin is moved forward to Bailey's goal line, Thaddeus scores a touchdown, and receives 6 points. Thaddeus declares he will attempt an extra point. The coin is placed on Bailey's 10 yard line. Thaddeus rolls a 4 and Bailey rolls a 2 so Thaddeus is awarded an extra point. Score: Thaddeus 7, Bailey 0.

Second Drive: Kickoff—The coin is placed on Thaddeus's 40 yard line and Thaddeus rolls a 2, so the coin is moved forward 20 yards to Bailey's 40 yard line. First down—Bailey rolls a 4 and Thaddeus rolls a 4, so the coin is not moved. Second down—Bailey rolls a 5 and Thaddeus rolls a 2, so the coin is moved forward 30 yards to Thaddeus's 30 yard line. Third down—Bailey rolls a 1 and Thaddeus rolls a 5, so the coin is not moved. Fourth down—Bailey declares that he will attempt a field goal, Bailey rolls a 5 and Thaddeus rolls a 5, so the field goal is good (with 10 yards to spare) and Bailey is awarded 3 points. Score: Thaddeus 7, Bailey 3.

Third drive: Kickoff—The coin is placed on Bailey's 40 yard line and Bailey rolls a 3, so the coin is moved 30 yards to Thaddeus's 30 yard line. First down—Thaddeus rolls a 4 and Bailey rolls a 3, so the coin is moved forward 10 yards to Thaddeus's 40 yard line. Second down—Thaddeus rolls a 2 and Bailey rolls a 5, so the coin is not moved. Third down—Thaddeus rolls a 5 and Bailey rolls a 6, so the coin is moved back 10 yards to Thaddeus's 30 yard line. Fourth down—Thaddeus declares he will punt; Thaddeus rolls 4 and Bailey rolls a 5, so the coin is moved forward 40 yards to Bailey's 30 yard line, and Bailey takes over as offense and begins his next drive.

The game may then continue until the end of the game is reached in accordance with the game duration agreed to by the players.

CONCLUSION

Thus, this football board game can be played with a hand-drawn board, a coin such as a penny, and a single pair of dice.

The present invention has now been described in connection with a number of specific embodiments thereof. However, numerous modifications which are contemplated as falling within the scope of the present invention should now be apparent to those skilled in the art. For example, the visual feel of the application and particular controls could be implemented in different ways. Different software and hardware platforms and services can be assembled in different ways to achieve similar results in different circumstances. And systems could be developed for other types of sales, such as commodities, hard goods or real estate. Therefore, it is intended that the scope of the present invention be limited only by the scope of the claims appended hereto. In addition, the order of presentation of the claims should not be construed to limit the scope of any particular term in the claims.

What is claimed is:

1. A method for playing a football board game comprising the steps of:

placing a marker on a first position on a board that represents a football field;

rolling a single first die by an offensive player to yield a first value;

rolling a single second die by a defensive player to yield a second value;

comparing the first value to the second value; and determining a distance by which the marker will be moved on the board based solely upon the step of comparing the first value to the second value;

wherein he step of comparing includes determining the distance to be an amount by which the first value exceeds the second value, wherein the distance is a gain of ten yards multiplied by the amount;

andwherein the step of comparing further includes determining the distance to be a loss of ten yards if the second value is a six, and determining the distance to be zero if the second value is greater than or equal to the first value.

* * * * *